US005636611A

United States Patent [19]

Fränkle et al.

[11] Patent Number: 5,636,611

[45] Date of Patent: Jun. 10, 1997

[54] ARRANGEMENT FOR CONTROLLING AIR COMPRESSED IN A CYLINDER OF A DIESEL ENGINE

[75] Inventors: Gerhard Fränkle, Remshalden; Magnus Korte, Leonberg; Thomas Schmitz, Leutenbach, all of Germany

[73] Assignee: Mercedes-Benz AG, Stuttgart, Germany

[21] Appl. No.: 622,836

[22] Filed: Mar. 27, 1996

[30] Foreign Application Priority Data

Apr. 14, 1995 [DE] Germany ..... 195 14 116.4

[51] Int. Cl.[6] ..... F01L 13/06

[52] U.S. Cl. ..... 123/322; 123/324

[58] Field of Search ..... 123/320, 321, 123/322, 323, 324

[56] References Cited

U.S. PATENT DOCUMENTS

| | | | |
|---|---|---|---|
| 3,426,523 | 2/1969 | Straub | 123/321 |
| 3,919,986 | 11/1975 | Goto | 123/324 |
| 5,000,146 | 3/1991 | Szucsanyi | 123/321 |
| 5,315,974 | 5/1994 | Sabelstrom et al. | 123/320 |
| 5,564,386 | 10/1996 | Korte et al. | 123/321 |

FOREIGN PATENT DOCUMENTS

| | | |
|---|---|---|
| 3904497 | 1/1990 | Germany . |
| 4309860 | 6/1994 | Germany . |

*Primary Examiner*—Willis R. Wolfe
*Attorney, Agent, or Firm*—Klaus J. Bach

[57] ABSTRACT

In an arrangement for controlling the flow of compressed air from a cylinder of a Diesel engine which includes a decompression valve mounted on a cylinder to permit the discharge of compressed air from the cylinder into a discharge passage, the decompression valve is operable by high pressure fuel admitted to an operating cylinder of the decompression valve via a control line including a magnetic control valve for the admission of fuel from a high pressure fuel distribution duct from which fuel is also supplied to the engine fuel injectors via an injection pipe which also includes a magnetic control valve, and both control valves are operable by a control unit which independently energizes the magnetic control valves.

5 Claims, 2 Drawing Sheets

ARRANGEMENT FOR CONTROLLING AIR COMPRESSED IN A CYLINDER OF A DIESEL ENGINE

BACKGROUND OF THE INVENTION

The invention relates to the controlled extraction of compressed air from a cylinder of Diesel engine by way of a decompression valve which is operated by fuel available from a high pressure fuel line, wherein the admission of high pressure fuel to the decompression valve is controlled by an electromagnetic control valve.

In principle, such apparatus are known from the German patent specifications DE 39 04 497 C1 and DE 43 09 860 C1.

With the apparatus disclosed in these references, the air compressed in a cylinder by a piston of a Diesel engine can be supplied selectively to a compressed air line leading to a compressed air storage tank or to the exhaust system of the engine. the air is extracted from the cylinder by way of a control valve disposed in the cylinder head. The control valve is opened when the pressure of the air compressed in the cylinder has reached for example a predetermined operating pressure of the compressed air tank.

For actuating the control valve, a pressurized hydraulic or pneumatic control fluid is admitted to a control cylinder which is connected to the control valve.

The control valve may be for example, the decompression valve which is anyhow present in most Diesel engines.

The high pressure fluid may be provided by high pressure pumps. Such pumps by which high fluid pressures for common oil fluid supply systems can be generated, are well known in the art.

The expression "common rail" refers to high pressure conduits in which a sufficiently high fluid pressure is maintained to provide high pressure fluid to various consumers such as hydraulic or pneumatic operating cylinders.

It is the object of the present invention to provide an arrangement by which compressed air can be extracted from cylinders of a Diesel engine for supply to a compressed air tank or for other uses or purposes in a simple and accurately controllable manner utilizing high pressure fluid provided by a high pressure fluid pump present in a Diesel engine.

SUMMARY OF THE INVENTION

In an arrangement for controlling the flow of compressed air from a cylinder of a Diesel engine which includes a decompression valve mounted on a cylinder to permit the discharge of compressed air from the cylinder into a discharge passage, the decompression valve is operable by high pressure fuel admitted to an operating cylinder of the decompression valve via a control line including a magnetic control valve for the admission of fuel from a high pressure fuel distribution duct, from which fuel is also supplied to the engines fuel injectors via an injection pipe which also includes a magnetic control valve and both control valves are under the control of a control unit which independently energizes the magnetic control valves.

Since the pressure of the high pressure fuel injection system which is generated by a high pressure fuel injection pump, is always present at the control valve or the decompression valve, respectively, when the engine is operating, the high pressure fuel for actuating the decompression valve is always readily available so that the valve can be actuated by the control unit at any time for the discharge of pressurized air from the engine cylinder. At the same time, the high pressure fuel pump, which is present and operating anyhow, is used for an additional purpose.

Preferred embodiments of the invention are described below in principle on the basis of the accompanying drawings.

BRIEF DESCRIPTIONS OF THE DRAWINGS

DESCRIPTION OF PREFERRED EMBODIMENTS

Figure 1:
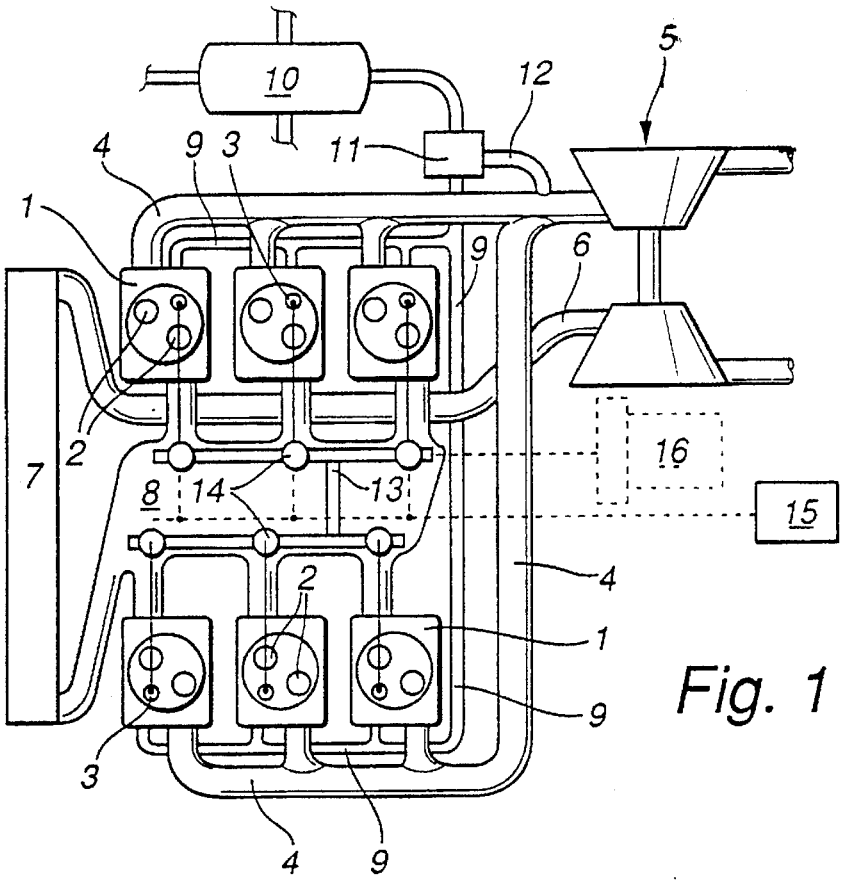
FIG. 1 shows a first embodiment of an arrangement according to the invention.

FIG. 1 is a schematic top view of an internal combustion engine with six cylinders 1 each of which includes intake and exhaust valves 2 and a decompression valve 3.

From the various cylinders 1, exhaust pipes 4 lead to a turbocharger 5 from which an air supply pipe 6 leads to an intercooler 7. From the intercooler 7, an air pipe extends to an intake manifold 8 which is connected to the inlet ports of the various cylinders 1 of the engine to supply air to the cylinders.

From the cylinders 1, compressed air pipes 9 extend to a compressed air tank 10 so that air compressed in the cylinders during the engine compression stroke can be supplied to the air tank through the compressed air pipes in a known manner.

The compressed air pipe 9 includes, ahead of the compressed air tank 10, a switch-over valve 11 which provides a communication path for the air compressed in, and discharged from, a cylinder either to the compressed air tank 10 or, via a branch conduit 12, to the engine exhaust pipe 4.

Depending on the air pressure in the compressed air tank 10, the switch-over valve 11 is controlled by a suitable control unit 15 to direct the compressed air either to the exhaust pipe to avoid the development of excessive air pressure in the compressed air tank or, when the air pressure in the compressed air tank is below a certain value, to the compressed air tank so as to maintain therein a desired air pressure.

From the compressed air tank 10, the air can be supplied to various compressed air users.

The various decompression valves 3 are operated by the pressurized fluid of a common rail high pressure system by which the valves 3 can be selectively actuated depending on the need for compressed air. Each decompression valve 3 can be independently controlled by way of a magnetic valve 14, one magnetic valve 14 being provided for each decompression valve 3 to permit fully independent control of the various decompression valves.

The fluid pressure in the common rail system 13 is generated by a high pressure fuel pump 16 which is not shown in detail, but only indicated by dashed lines. The fuel pressurized by the high pressure pump 16 is utilized for the operation of the decompression valves 3 indirectly by way of the common rail system 13.

The common rail system 13 is preferably part of the fuel injection system of the Diesel engine or it may be part of an independent hydraulic system.

Such common rail systems are installed in many vehicles in any case to provide a source of pressurized fluid for the operation of various components. To use such a system has the advantage that there is no need for other apparatus for the generation of fluid under high pressure for the operation of the various decompression valves 3.

Since, in a common rail system 13, there is always a sufficiently high system pressure capable of operating the decompression valves 3 at practically any desired point in time, it is only necessary to energize one or more of the magnetic valves 14 by a suitable control unit 15 depending on the compressed air requirements. Such a control device may be, for example, the engine electronic control unit 15 which is programmed to energize the magnetic valves 14 before the engine pistons reach their upper dead center positions whereby, through selective energization of the various magnetic valves 14, the air supply to the compressed air tank 10 can be controlled in a simple manner.

Figure 2:
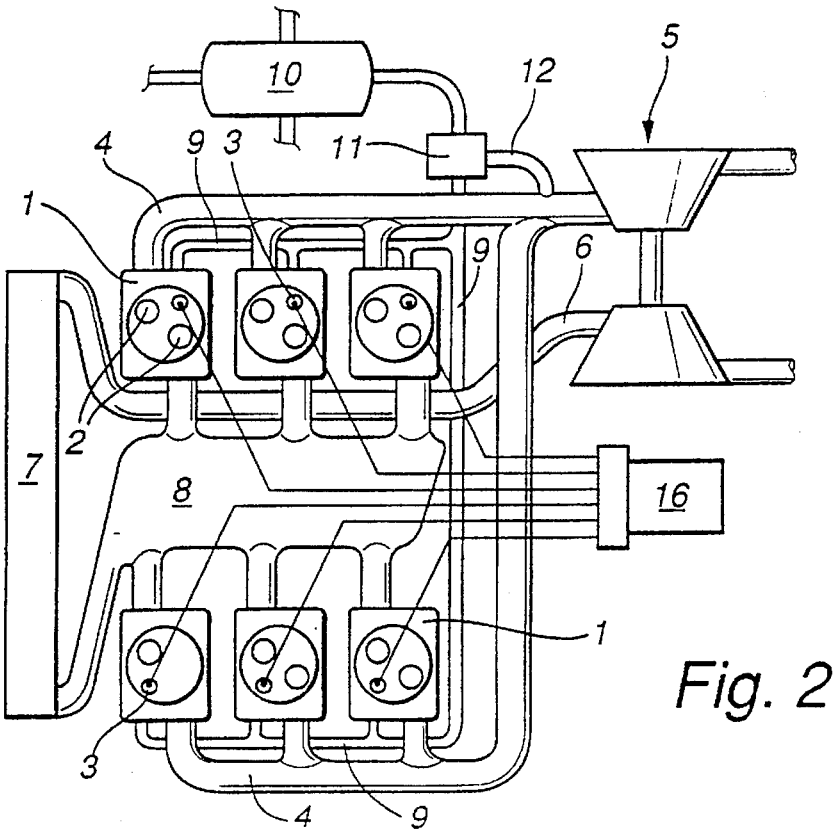
FIG. 2 shows a second embodiment.

FIG. 2 shows another embodiment of the invention wherein the decompression valves 3 are operated directly by a high pressure pump 16 which has variable high pressure fluid supply periods (control periods).

By varying the control periods of the high pressure pump 16, for example, by means of an adjustable swash plate or by way of a suitable coordination of the pump gear with the drive gear by means of a variable transmission between the driving means for the high pressure pump and the high pressure pump 16, the window during which the decompression valve 3 is opened can be changed to "early" in the compression stroke of the engine, for example.

This means that the decompression valve 3 is opened earlier in the engine compression stroke and is also closed again earlier than this would be the case under normal conditions, so that the compressed air is discharged at a somewhat lower pressure corresponding to the engine compression pressure before TDC when the decompression valve closes.

Such an arrangement would be suitable particularly for vehicles which are not provided with a common rail system so that, also with these vehicles, the decompression valve 3 can be controlled and operated in a simple manner.

Figure 3:
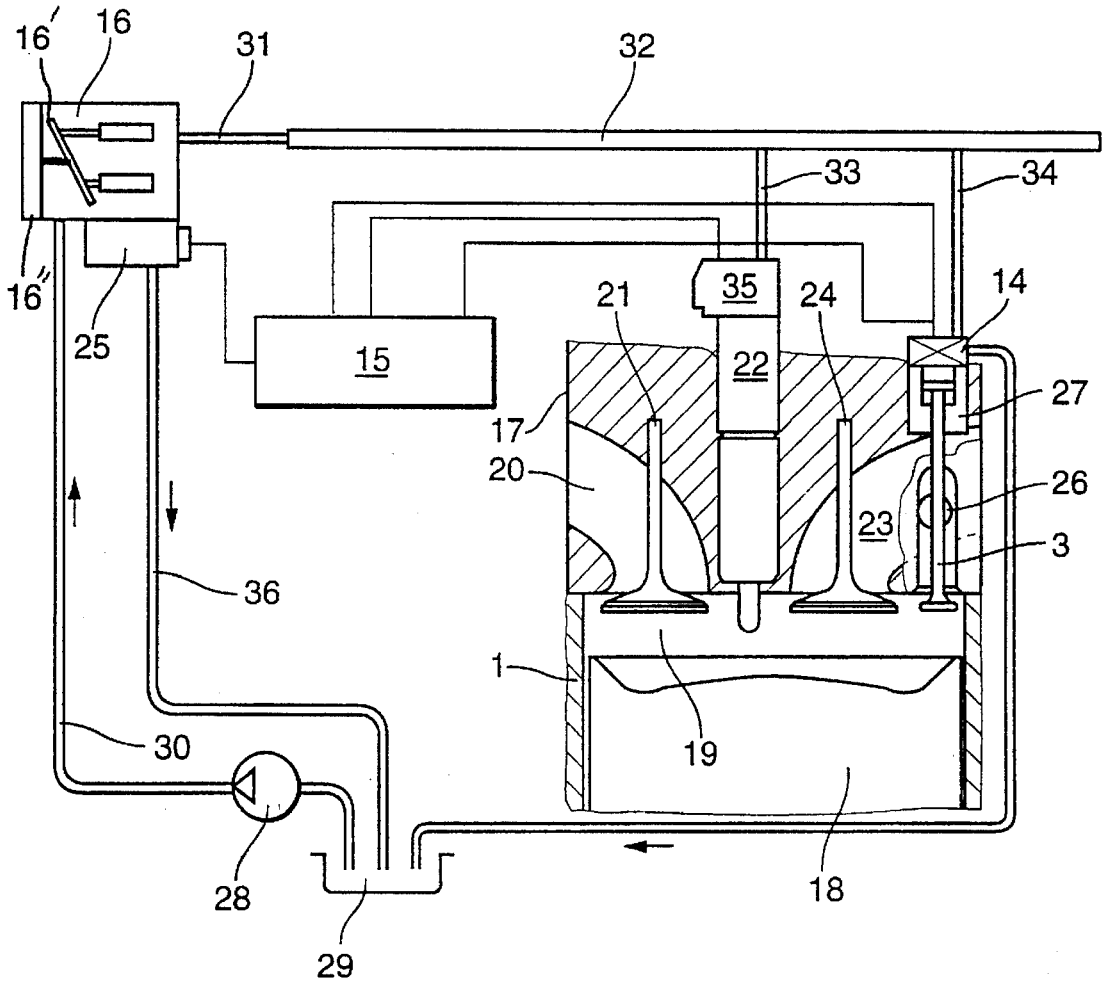
FIG. 3 shows details of a common rail system as employed in the arrangement of FIG. 1 on the basis of a schematic cross-sectional view of a cylinder including a decompression valve.

FIG. 3 is a cross-sectional view of a cylinder showing schematically in greater detail a common rail system 13 as presented in FIG. 1. Components which are already present in FIG. 1 are indicated by the same reference numerals.

A cylinder head 17 is mounted on the cylinder 1. Each cylinder 1 includes a piston 18 and, between the piston 18 and the cylinder head 17, a combustion chamber 19 into which air is sucked by way of an intake passage 20 including an intake valve 21, and in which the air is compressed by the piston 18. An injector 22 is mounted on the cylinder head and extends into the combustion chamber 19 so that fuel can be injected into the air compressed in the combustion chamber for combustion therein. The gases generated during the combustion are discharged through an exhaust passage 23 including an exhaust valve 24 into an exhaust pipe 4.

In addition to the intake and exhaust valves 21 and 24 the cylinder head 17 includes, for each cylinder 1, a decompression valve 3 which controls communication of the combustion chamber 19 with a discharge passage 26. Outside the cylinder head 17, each discharge passage 26 is connected to a compressed air collection pipe 9. The decompression valve 3 includes an operating cylinder 27 to which high pressure fuel can be admitted under the control of a magnetic valve 14 for operating the decompression valve 3.

The common rail system, which in the present case is principally a high pressure fuel system for supplying fuel to the fuel injectors 22, includes a high pressure pump 16 to which fuel is supplied by a low pressure fuel pump 28 from a fuel tank 29 by way of a fuel supply line 30. From the high pressure pump 16, the fuel is introduced to a high pressure distribution and storage duct 32 (common rail) by way of a high pressure line 31.

The high pressure pump 16 is provided with a pressure control valve 25, by which the fuel pressure in the high pressure fuel distribution and storage duct 32 can be adjusted dependent on signals of the control unit 15. For this purpose, excess fuel supplied by the high pressure pump 16 can be discharged by the pressure control valve 25 through a return line 36 to the fuel tank 29. The pump 16 may also have an adjustable swash plate 16' by which the pumping volume can be controlled or it may be driven by way of a variable transmission 16" for adjusting the pump speed depending on pumping requirements.

Each fuel injector 22 is connected to the high pressure fuel distribution and storage duct 32 by an individual fuel injection pipe 33 and each of the operating cylinders 27 is connected to the high pressure fuel distribution line 32 by a control line 34. High pressure fuel is admitted from the high pressure fuel distribution and storage duct 32 to the fuel injectors 22 and to the decompression valve operating cylinder 27 by means of the magnetic valves 35 and 14, the magnetic valve 35 being arranged at the inlet to the injector for controlling fuel admission to the injector and the magnetic valve 14 being arranged at the inlet of the operating cylinder 27 for controlling the operation of the decompression valve.

The magnetic valves 14 and 35 are energized by the control unit 15 wherein the control unit may be an electronic device providing control depending on engine operating parameters or on values inputted manually or stored in the control unit. In addition to the possibilities mentioned in connection with the embodiment of FIG. 1 such as the use of the decompression valve for motor braking operation or the filling of a compressed air tank 10 by supplying thereto air compressed in the engine combustion chamber during the compression stroke, it is also possible to control the valves 14 in such a way that compressed air from the compressed air tank 10 is blown into the combustion chamber 19 by way of the compressed air pipe 9 and passage 26 for improved combustion.

Also, the electronic control unit can control the decompression valves 3 in such a way hat, during the start-up phase of engine operation, the decompression valves are opened at the beginning of the engine compression stroke to increase the air charge of the combustion chambers of an engine to thereby facilitate engine start-up.

What is claimed is:

1. Arrangement for controlling the flow of compressed air from a cylinder of a Diesel engine, said arrangement comprising: a decompression valve mounted on said cylinder so as to normally close a discharge passage and having an operating cylinder for opening said decompression valve, a fuel injector for injecting fuel under pressure into said cylinder, a high pressure fuel distribution duct, a high pressure fuel pump in communication with said high pressure fuel distribution duct, a high pressure fuel injection pipe extending between said high pressure fuel distribution duct and said fuel injector and including a magnetic valve for controlling the admission of fuel to said injector, and a separate control line extending between said fuel distribution duct and the operating cylinder of said decompression valve and including a magnetic control valve for controlling the admission of high pressure fuel from said high pressure fuel distribution duct to said operating cylinder for controlling operation of said decompression valve and a control unit in communication with the magnetic valves in said fuel injection pipe and in said control line for independently controlling the admission of high pressure fuel to said injectors and said decompression valves.

2. An arrangement according to claim 1, wherein said engine includes a cylinder head with intake and exhaust valves and said decompression valve is arranged on said cylinder head in addition to said intake and exhaust valves.

3. An arrangement according to claim 1, wherein said discharge passage extends from said decompression valve to a compressed air pipe which includes a switch-over valve for supplying said compressed air selectively to a compressed air tank or to an engine exhaust pipe.

4. An arrangement according to claim 1, wherein said high pressure fuel pump includes a swash plate allowing adjustment of the amount of high pressure fuel delivered by said high pressure pump.

5. An arrangement according to claim 1, wherein said high pressure fuel pump includes drive means having a variable transmission for the adjustment of the amount of high pressure fuel delivered by said high pressure pump.

* * * * *